United States Patent [19]

Williams

[11] Patent Number: 5,012,979

[45] Date of Patent: May 7, 1991

[54] ADJUSTABLE FOAMING CHAMBER STEM FOR FOAM-APPLYING NOZZLE

[75] Inventor: Leslie P. Williams, Vidoo, Tex.

[73] Assignee: CCA, Inc., Port Neches, Tex.

[21] Appl. No.: 343,683

[22] Filed: Apr. 27, 1989

[51] Int. Cl.[5] ..... A62C 31/12

[52] U.S. Cl. ..... 239/416.5; 239/424.5; 239/432; 239/520; 239/581.1

[58] Field of Search ..... 239/343, 432, 416.5, 239/423, 424.5, 519, 581.1, 570; 169/14, 15

[56] References Cited

U.S. PATENT DOCUMENTS

| | | | |
|---|---|---|---|
| 2,086,711 | 7/1937 | Friedrich | 169/15 X |
| 3,094,171 | 6/1963 | Gagliardo | 169/15 |
| 3,188,009 | 6/1965 | Miscovich | 169/15 X |
| 3,236,458 | 2/1966 | Ramis | 239/343 X |
| 4,224,956 | 9/1980 | Klein | 169/14 X |
| 4,497,442 | 2/1985 | Williams | 239/318 X |
| 4,640,461 | 2/1987 | Williams | 239/314 |

FOREIGN PATENT DOCUMENTS

| | | | |
|---|---|---|---|
| 506435 | 10/1951 | Belgium | 169/15 |
| 826841 | 9/1937 | France | 169/15 |

*Primary Examiner*—Andres Kashnikow
*Assistant Examiner*—Kevin Weldon
*Attorney, Agent, or Firm*—Pravel, Gambrell, Hewitt, Kimball & Kreiger

[57] ABSTRACT

A quickly adjustable foaming chamber stem for a foam-applying fire-fighting nozzle wherein the fire-fighter can quickly switch from applying on optimum foam to a stream with an optimum throw. The stem is comprised of a deflector plate and a mixing plate that define a foaming chamber there between, the deflector plate having ducts that, when open, communicate a portion of the liquid and foam-stabilizing concentrate into the chamber to form a foam. The foaming chamber, maintained at approximately atmospheric pressure, forms a small homogeneously bubbled maximum foam through liquid from the ducts striking and reflecting from the mixing plate, causing thereby turbulence and agitation. Surface portions of the mixing plate are inclined to maximize agitation.

13 Claims, 3 Drawing Sheets

ADJUSTABLE FOAMING CHAMBER STEM FOR FOAM-APPLYING NOZZLE

BACKGROUND OF THE INVENTION

1. Field of the Invention

This invention relates to the field of foam-forming equipment for fire extinguishing purposes, and more particularly to nozzles for the application of a foam formed from a liquid and foam-stabilizer mix.

2. Description of the Prior Art

Fire-fighting nozzles for the application of a water stream or a water fog have been known for some time. Such nozzles are attached to a fire hose and are adjusted to apply the fire-extinguishing liquid in a pattern ranging from a fog-like application to a straight stream. Liquid mixtures containing a foam-stabilizing concentrate have also been utilized in fire-fighting nozzles for the extinguishing of certain types or classes of fires. These foam-stabilizing concentrates will, when mixed with a liquid, aerated, and mechanically agitated, form a relatively stable foam that is particularly useful for the extinguishing of large fires.

The stabilizer is generally supplied as a concentrate that is inducted into the flowing liquid stream to form mixture. Examples of such liquid foam-stabilizing concentrates are known under the trademarks, Light Water® "AFFF," Light Water® "AFFF/ATC" of Minnesota Mining and Manufacturing Company, Minnesota and "Emulsiflame TM" of Elkhart Brass Manufacturing Co., Inc. Other such stabilizers are generally described in U.S. Pat. Nos. 3,772,195; 3,562,156; 3,578,590; and 3,548,949.

The inventions described in U.S. Pat. Nos. 4,497,442 and 4,640,461 disclose nozzles for applying a foam wherein a foam-stabilizing concentrate is inducted into a segment of a general flowing liquid stream, such as water, through the nozzle. In these inventions, the general inner bore of the nozzle communicates a liquid stream from a hose to the point of discharge. Educator means within the inner bore extracts a foam-stabilizing concentrate from a supply and inducts it into a previously separated first segment of the liquid stream flowing through the general inner bore. At the discharge stem end of the nozzle the concentrate and liquid is agitated and aerated in a foam-forming chamber to form a stabilized foam and mixed with the remainder of the liquid stream. After combination with the remainder of the liquid stream, the foam is "thrown" in a desired pattern. An adjustable flow regulating means can regulate the rate of flow (gallons per minute) of the stream discharged.

The nozzle of U.S. Pat. No. 4,497,442 improved the focus for the foam-liquid mixture discharged from the nozzle, reducing the dispersion of the foam stream from that discharged by previous nozzles. As a result, the nozzle of U.S. Pat. No. 4,497,442 could apply or throw the foam over a greater distance than previous foam nozzles, without the utilization of subsidiary pump means, thereby allowing the fire-fighter to operate a simplified nozzle and be freely removed from the fire.

A general limitation, however, affecting the above inventions, and other nozzles, is that the nozzles are unable to produce, within the expansion range applicable to fire-fighting nozzles, a relatively highly aerated foam, with homogeneous bubbles, and also quickly adjust to supply a less-aerated foam with a higher, more optimal throw. Ideally, the fire-fighter should be able to quickly and easily adjust between an optimal foam and an optimal throw as conditions dictate. Highly aerated foam is advantageous in that it is more effective on polar solvent and alcohol fires. An optimal throw permits the fire-fighter to remain further removed from the fire and is suitable for hydrocarbon fires. The amount of agitation required to produce an optimal expansion varies with the concentrate formulation, water temperature, and water purity.

SUMMARY OF THE INVENTION

The present invention discloses a quickly adjustable foaming chamber stem for a foam-applying fire-fighting nozzle. On the one hand, an optimum, highly aerated, homogeneously bubbled foam can be applied from the nozzle. On the other hand, the fire-fighter can quickly switch to apply a less-aerated foam with an optimum throw. The present invention further provides a stem that can attach to a variety of foam-applying nozzles, either with or without an interior educator system, for inducting the foam-stabilizing concentrate into the liquid flow in the nozzle.

The stem is comprised of a deflector plate and a mixing plate that define a foaming chamber there between. The deflector plate is attached to the nozzle near the discharge end of the nozzle's inner bore such that the plate restricts the flow of the liquid discharged from the inner bore of the nozzle. The major portion of the liquid flow is deflected around the periphery of the deflector plate. The deflector plate has however a plurality of ducts that, when open, communicate a second portion of the liquid through the ducts and into the mixing chamber. Flow through the ducts in the deflector plate strike the mixing plate. The surface of the mixing plate is oriented such that portions of the liquid flowing through the ducts are reflected toward the center area of the mixing chamber. Means are provided to open and close at least some of the ducts. Means are provided to attach the stem to the nozzle.

The stem is designed to be compatible with a nozzle wherein the stabilizer is generally mixed with a segment of the liquid as the liquid flows through the bore of the nozzle. In this system, the stabilizer is inducted and mixed with a portion of the liquid in the bore of a central structural member. This stabilizer and liquid mixture is delivered to the mixing chamber through a central duct in the deflector plate.

Preferably, the ducts through the deflector plate, other than one central duct, are arranged around the periphery of the plate. Portions of the mixing plate struck by liquid flowing through the ducts of the deflector plate, other than the one central duct, are oriented to deflect the flow of liquid toward the central area of the mixing chamber and more particularly toward the junction of the deflector plate with the central area of the mixing chamber. The junction of the deflector plate with the central area of the mixing chamber will contain the opening of the one central duct. That duct may or may not communicate liquid flow, depending upon the style of nozzle to which the stem is attached.

BRIEF DESCRIPTIONS OF THE DRAWINGS

DESCRIPTION OF THE PREFERRED EMBODIMENTS

Figure 1:
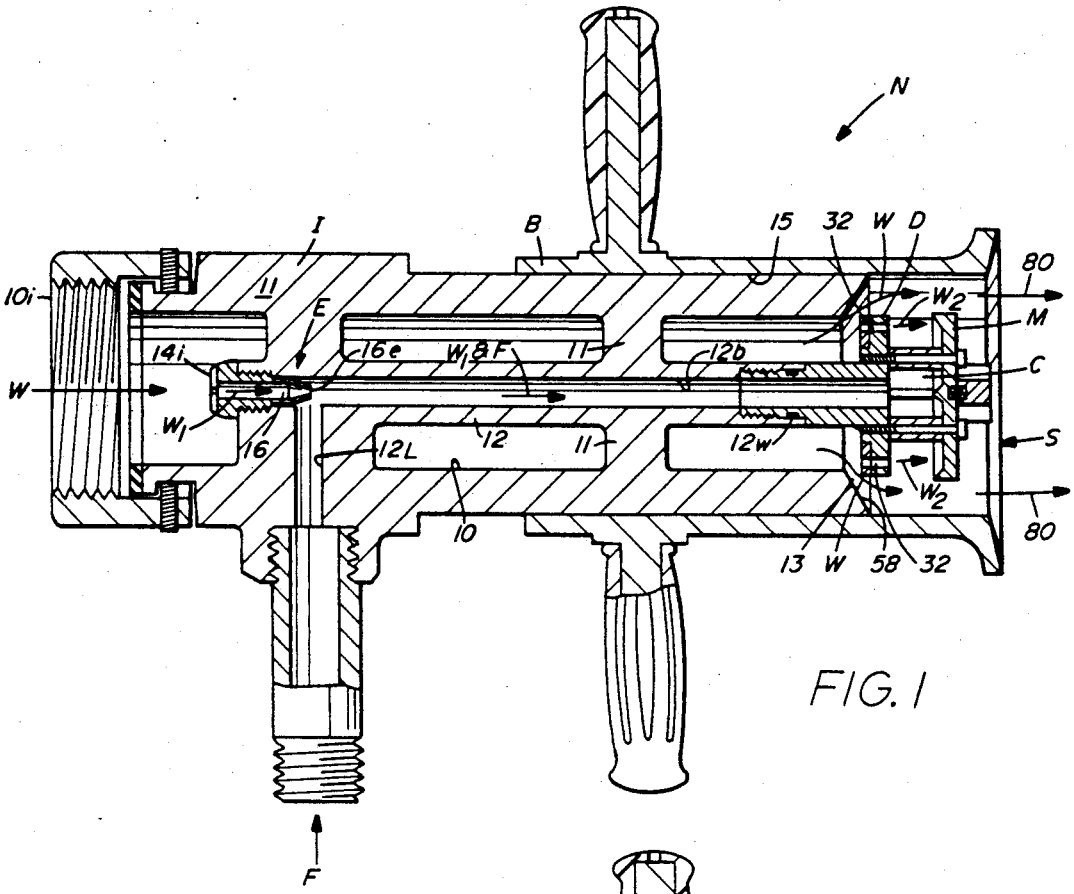
FIG. 1 is a cross sectional view of the present invention attached to a nozzle with a straight bore and a stabilizer induction channel within the inner bore.

In Drawings 1, 2, and 3, the letter N refers generally to a foam-applying nozzle of the type used for fire-extinguishing purposes. The nozzle is adapted to apply a foam stream that exits the nozzles in the direction of arrows 80, the foam stream composed of a liquid W and a foam-stabilizing concentrate F. Briefly, the nozzle N includes an inner barrel I having an axial bore 10 with inlet 10*i* and outlet 10*o* for directing a liquid stream W from a hose, monitor, or other source (not shown). For reasons unrelated to this invention, the inlet 10*i* and outlet 10*o* may be of lesser diameter than bore 10, as illustrated by the nozzles in FIGS. 2 and 3. Such orificing of the inlet and outlet of the nozzle bore does not affect the dynamics of the nozzle and stem as disclosed. Inner barrel I contains structural elements 11 transversing bore 10 and structural element 12 essentially paralleling the length of bore 10. Further use of structural element 12 is described below.

Nozzle N may further involve a flow-regulating means coacting with the outlet 10*o* for regulating the lateral extent and the flow of the stream W (or W plus F) discharged from inner barrel I. The flow-regulating means generally includes the coactions of deflector plate D with the bore 15 of adjustable outer barrel B, being a tubular member telescopically mounted with inner barrel I, and with reflection edge 58 of the outlet 10*o* of inner barrel I. Deflector plate D is spaced apart, by distance 13, from the annular edge 58 to provide the opening through which a major portion of the fluid stream W (or W plus F) flows. The stem, comprised of deflector plate D and mixing plate M, is threadedly connected to structural portion 12 of inner barrel I. Provision is made for the placement of washers 12*w* in the threaded connection between the stem and the structural member such that distance 13 between deflector plate D and reflection edge 58 may be varied. The distance 13 between the edge of the deflector plate and the reflection edge essentially controls or regulates the amount of flow of the liquid stream W (or W plus F) through nozzle N.

Furthermore, as outer sleeve B is rotated or moved relative to inner barrel I, the overall length of nozzle N is increased or decreased. The positioning of outer sleeve B controllably selects the type of application, which ranges between positions creating a fog-like foam application to a position forming a straight-stream foam application. By varying distance 13, above, and the adjustable outer barrel B in relation to inner barrel I, the discharged fluid stream may be varied from a relatively compact small diameter stream to a wider, larger diameter spray.

Figure 2:
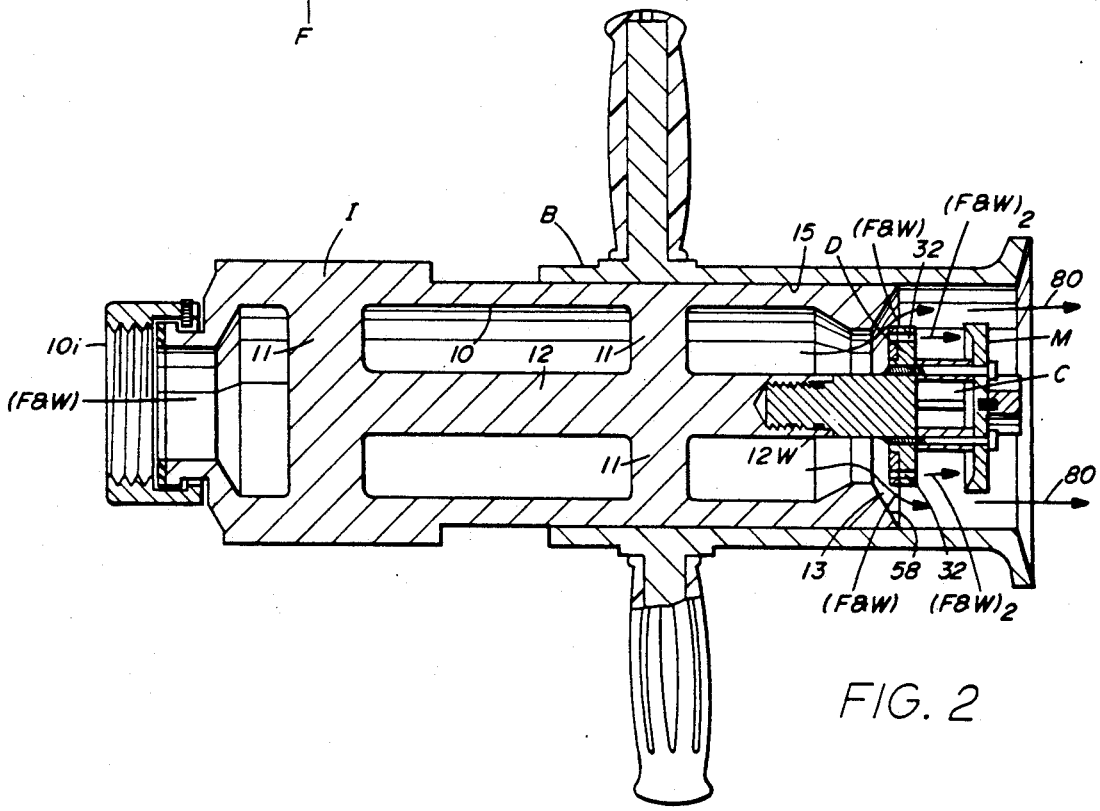
FIG. 2 is a cross sectional view of the present invention attached to a nozzle with an orificed bore and with no stabilizer induction channel within the inner bore.
Figure 3:
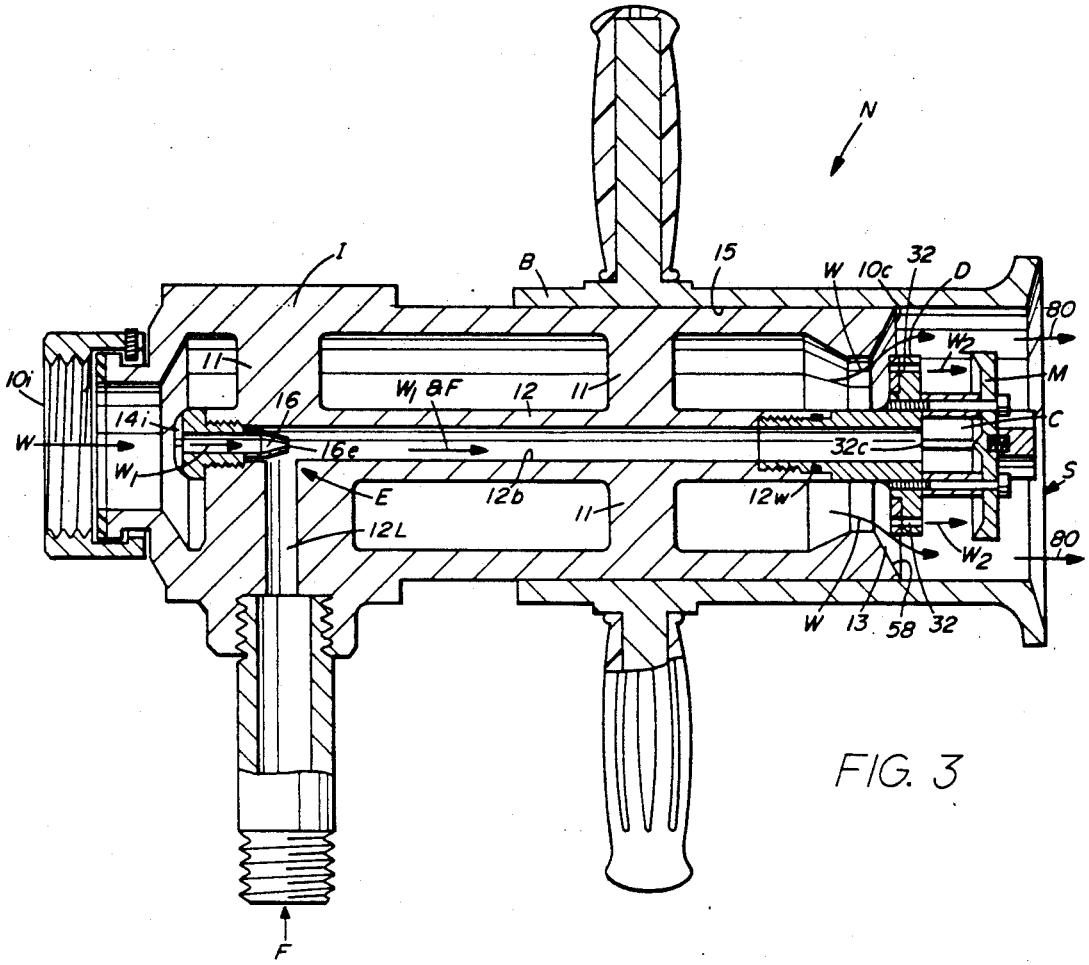
FIG. 3 is a cross sectional view of the present invention attached to a nozzle with an orificed bore and with a stabilizer inductor channel within the inner bore.

Foam-stabilizing concentrate F may be supplied together with liquid W through inlet 10*i* of the inner barrel, as illustrated in FIG. 2. Alternately, as illustrated in FIGS. 1 and 3, eductor means E may be provided within inner barrel I to extract foam-stabilizing concentrate F from an outside supply and supply the concentrate to the mixing chamber of the stem. The educator means E forms a composition of F and liquid W by inducting a selected amount of the concentrate into a first portion W1 of the liquid stream W flowing through the inner barrel I, as follows. The eductor means E shown is generally comprised of a venturi type tube mounted within the structural member 12 within axial bore 10 of inner barrel I and is axially aligned with the flow of the liquid stream. As the liquid stream W flows into the inlet 10*i*, a first portion W1 of the stream W flows into tubular member 14, at inlet 14*i*, located within structural member 12. Tubular member 14 has a constricting portion 16 with an exit 16*e*. The first stream portion W1 exits from the member 14 at exit 16*e* and enters the axial bore 12*b* of structural member 12. While one branch of structural member 12 is adapted to receive member 14 and to contain axial bore 12*b*, the lower base segment 12*c* is adapted to receive the stabilizer concentrate to be mixed with the liquid. The interior cavity of bore 12*b* is larger dimensionally than the exit 16*e* of section 16 of member 14, thus causing the flow of stream W1 to expand in bore 12*b*. The expansion decreases the flow rate of the liquid stream portion W1. This slowing of the flow rate creates a reduced pressure in the bore 12*b* due to the venturi effect. The reduced pressure created by the venturi effect causes the substance F to flow from its supply so as to induct the substance F into the stream portion W1 in bore 12*b*. Structural member 12 is mounted having its axial bore 12*b* substantially aligned with the flow of the liquid stream W. Bore 12*b* has a discharge end with an outlet 12*o*, that feeds into mixing chamber C through a central duct 32*c* in deflector plate D of stem S.

Figure 4:
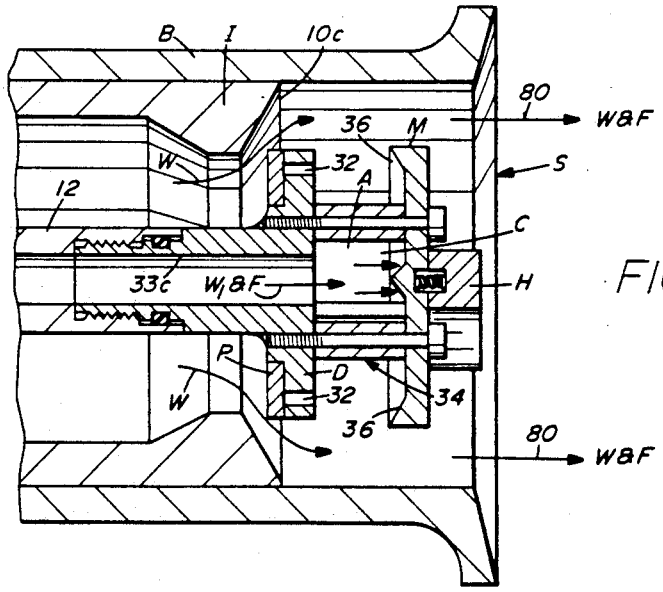
FIG. 4 is a cross sectional view of the present invention attached to a nozzle having a central duct that conducts fluid and with the peripheral ducts open.
Figure 5:
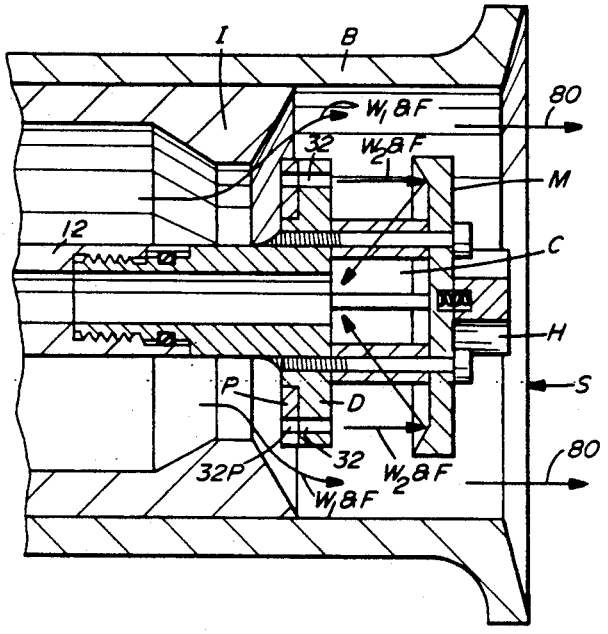
FIG. 5 is a cross sectional view of the present invention attached to a nozzle having a central duct that does not conduct fluid and with the peripheral ducts closed.

Referring now more particularly to FIGS. 4 and 5, stem S is formed of a mixing plate M and a spaced-apart deflector plate D that forms a mixing chamber C there between for producing a foam from the liquid W and the foam-stabilizing concentrate F. Mixing plate M and deflector plate D are preferably mounted substantially perpendicular to the longitudinal axis of inner barrel I. FIG. 4 illustrates a stem attached to a nozzle with an eductor chamber in the center of the inner bore structural member for presenting the foam-stabilizing concentrate F to the mixing chamber, as in the nozzles of FIGS. 1 and 3. FIG. 5 illustrates the stem attached to a nozzle with no induction chamber in the central structural member 12, as in FIG. 2. Rather, the foam-stabilizing concentrate F and liquid W are both introduced into the inlet 10*i* of the nozzle. In fact, if the foam-stabilizing concentrate F and liquid W are both introduced into inlet 10*i* of the nozzle, even if the nozzle has an eduction chamber E, the chamber can be used to induct additional air through bore 12*b* into mixing chamber C. In this case, the air would be inducted into a first stream portion W1 that itself was already mixed with concentrate F.

Deflector plate D directs the main portion of the liquid stream W radially around the periphery of the deflector plate, through opening 13 between plate D and inner bore reflector edge 58, and around the periphery of mixing plate M. Deflector plate D, in addition, contains ducts 32 that, when open, permit passage of liquid stream W2 into the mixing chamber. Stream W2 may contain liquid or liquid and foam-stabilizing concentrate, depending upon the nozzle, design and utilization. Deflector D further contains duct 32*c* that may introduce a further fluid stream W1, containing concentrate F, into chamber C. The force of streams W1 and W2 entering the mixing chamber, and the effect of the main portion of the liquid stream deflecting around the periphery of the plates, draws the foam formed in the mixing chamber into the main stream of liquid at the periphery of the mixing chamber. From thence it is thrown out of the nozzle along the path of arrows 80.

Foam is formed in the mixing chamber by the agitation and turbulence of the streams of liquid containing foam-stabilizer F and by their impact upon the mixing plate and the deflector plate. Streams W1 and W2 impact mixing plate M. The surface of plate M impacted by stream W2 is oriented to reflect the stream into the center area A of the mixing chamber C, area A being indicated by dashed lines in FIGS. 4 and 5. More particularly, in the preferred embodiment, surface portions 36 of mixing plate M impacted by the stream W2 deflect that stream toward the junction of center area A and deflector plate D, as indicated by the arrows in FIGS. 4 and 5. That junction contains the opening of central duct 32*c*, which duct may or may not be connected to a nozzle communicating fluid therethrough, depending upon the type of nozzle being utilized If duct 32*c* communicates fluid, that fluid, in the preferred embodiment, impacts mixing plate M at cone 34. The fluid, as illustrated in FIG. 4, is then deflected toward the periphery of the mixing chamber. To the extent that peripheral ducts 32 are open, the fluid flow from central duct 32*c*, reflected toward the periphery of the mixing chamber, will interact with and cause turbulence with the fluid from ducts 32 that are being reflected inward toward central area A of the mixing chamber. Two interactions of streams W2 with stream W1 take place. One takes place at the junction of duct 32*c* and the mixing chamber. The other takes place within the mixing chamber after stream W1 has been reflected outward by cone 34.

Mixing chamber C is maintained at approximately atmospheric pressure during the working of the nozzle. A mixing chamber at roughly atmospheric pressure is conducive to forming a foam comprised of small, thick-walled, homogeneous bubbles, which is the preferable foam for fire-fighting purposes.

When all ducts in deflector plate D are open, turbulence and agitation is maximized in the mixing chamber. A maximum foam is formed and pushed or drawn out into the main stream of liquid flowing around the periphery of the plates to be thereafter thrown from the nozzle. When some or all of the deflector ducts are closed, which is accomplished by turning handle H connected with plate P less foam is formed in the mixing chamber. The liquid stream with less foam discharged from the nozzle can be thrown from the nozzle at close to the nozzle's optimum throw distance.

In the preferred embodiment, handle H is attached to the outside, or discharge side, of mixing plate M. As exhibited in FIG. 6, handle H is attached by screws 64, spacers 68, and screws 76 to ring-shaped plate P that abuts the nozzle side of deflector plate D. Connecting pieces 68 extend through slots 72 and 74 in plates M and D respectively. Plate P contains ducts 32*p* that align with at least some of the ducts 32 of deflector plate D when plate P is in a first position. When plate P is moved to a second position, at least some of the ducts 32*p* in P and ducts 32 in D are not aligned and so at least some streams W2 are unable to communicate through the deflector plate. Spring 66 compressed between mixing plate M and handle H serves to bias plate P against deflector plate D to maintain the plate P in its first or second position.

Figure 6:
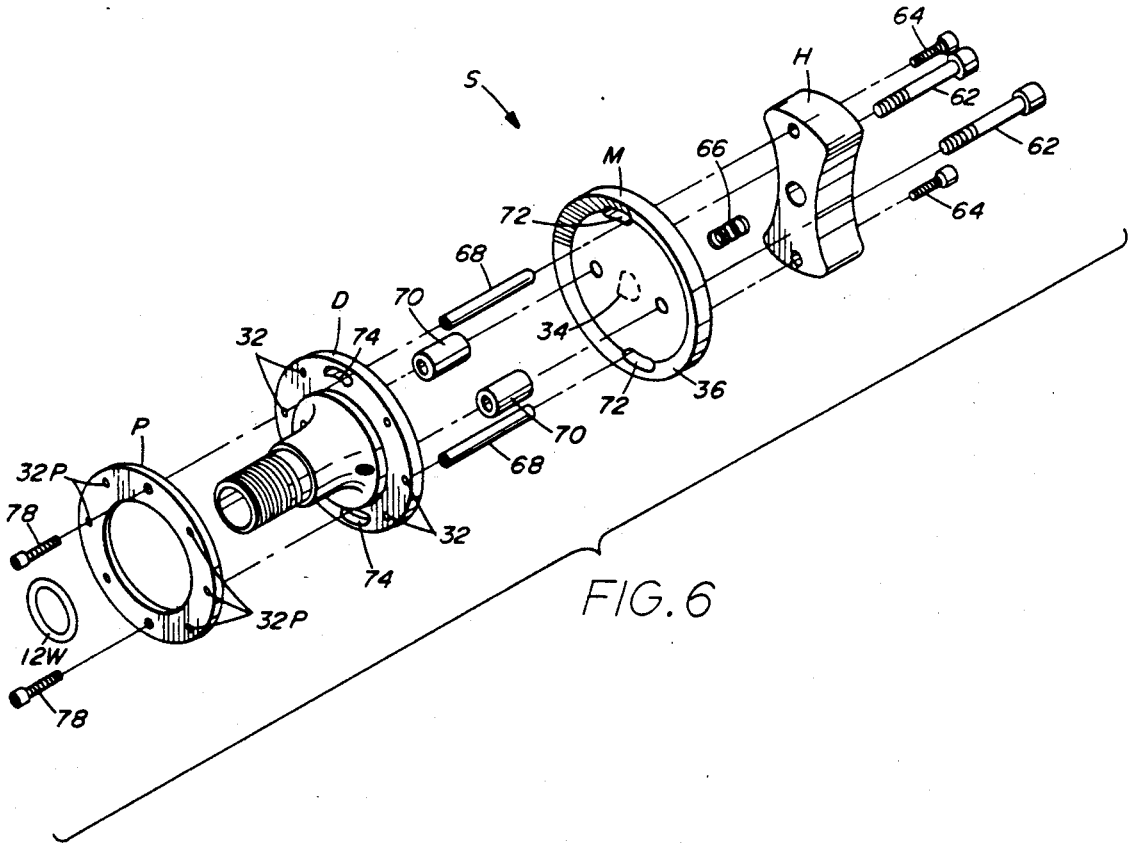
FIG. 6 is a break-away view exhibiting the construction of the stem.

FIG. 6 illustrates the construction of stem S in a preferred embodiment. Screws 62 extending through plate M and spacers 70 attach and space plate M from plate D. Spacers 70 can be varied to change the separation distance of M from D. Handle H is connected to plate P by means of connector pieces 68 that extend through opening 72 and 74 in plates M and D respectively. Screws 76 and 64 extending through plate P and M respectively, threadedly attach to connector pieces 68. Threaded element 12*t* illustrates the means for threadedly connecting the stem with central structural member 12 of the nozzle. Within threaded element 12*t* is the deflector plate's central duct 32*c*, which may or may not communicate with a bore in structural member 12. In FIG. 6, plate P is shown with ducts 32*p* that align with ducts 32 in deflector plate D when plate P is in a first position. Spacer washer 12*w* is shown for use in regulating the threaded connection of stem S with nozzle N in order to regulate distance 13 through which the main portion of the liquid stream discharges between the periphery of deflector plate D and reflector edge 58 of inner bore I.

FIG. 5 shows handle H and plate P oriented such that ducts 32 are open. FIG. 4 shows handle H and plate P oriented such that ducts 32 are not open. Handle H is easily graspable and turned by the fire-fighter during operation.

The foregoing disclosure and description of the invention are illustrative and explanatory thereof, and various changes in the size, shape, and materials, as well as in the details of the illustrated construction may be made without departing from the spirit of the invention.

I claim:

1. An adjustable foaming chamber stem for attachment to a foam-applying nozzle having a bore through which pass liquid and a stabilizer, comprising:

a deflector plate adapted to be affixed to the nozzle approximate the discharge end of the bore such that the plate restricts the flow of liquid discharged, the plate having a plurality of ducts that communicate through the plate in the direction of flow, at least some of the ducts being adjustable between an opened and a closed position;

a mixing plate affixed to and separated from the deflector plate such that some liquid flowing through the ducts strikes the mixing plate, the two plates forming a foaming chamber between them wherein the orientation of portions of the surface of the mixing plate is coordinated with the direction of flow of liquid from some of the ducts such that some liquid striking the mixing plate is reflected toward the center area of the mixing chamber;

means for opening and closing at least some ducts; and means for attaching the stem to the foam-applying nozzle.

2. The invention of claim 1, wherein the stabilizer is mixed with the liquid flowing through the bore of the nozzle.

3. The invention of claim 2, wherein the ducts are located around the periphery of the deflector plate.

4. The invention of claim 1, wherein one duct is located in the center of the deflector plate and the stabilizer is conveyed through the bore of the nozzle such that the stabilizer is conducted through the deflector plate through only the central duct.

5. The invention of claim 4, wherein the ducts other than the central duct are located around the periphery of the deflector plate.

6. The invention of claims 3 or 5, wherein the liquid reflected toward the center area of the mixing chamber is reflected more particularly toward the junction of the center area with the deflector plate.

7. The invention of claim 1, wherein the deflector plate is affixed to the nozzle such that the location of the deflector plate can be varied to vary the restriction that the plate offers to the flow of liquid around the periphery.

8. The invention of claim 1, wherein the distance that the mixing plate is separated from the deflector plate can be varied.

9. The invention of claim 6, wherein the ducts are oriented so that flow through the ducts is approximately parallel to flow through the nozzle bore and wherein some portions of the surface of the mixing plate are inclined inward to reflect the liquid from the ducts striking those portions toward the junction of the center area with the deflector plate.

10. The invention of claim 9, wherein the deflector plate and mixing plate are approximately circular and of substantially the same size and wherein the inside rim portion of the mixing plate, that faces the peripherally located ducts of the deflector plate, is inclined inward.

11. The invention of claim 4, wherein a portion of the surface of the mixing plate struck by the liquid and stabilizer communicated through the central duct assumes a conical shape with the apex facing the central duct.

12. The invention of claim 10, wherein the means for opening and closing some of the ducts is comprised of a third plate that abuts, is concentric with, and rotates with respect to, the deflector plate so that when the third plate is rotated to a first position, at least some of the ducts in the deflector plate are open and when the third plate is rotated to a second position, at least some of the ducts in the deflector plate are closed.

13. The invention of claim 12, wherein the third plate is rotated by means of a handle located forward of the mixing plate, which handle is affixed to the third plate by means that extend through the mixing plate and the deflector plate.

* * * * *